United States Patent [19]

Reiss et al.

[11] Patent Number: 4,550,514

[45] Date of Patent: Nov. 5, 1985

[54] STEAM IRON

[76] Inventors: Gerald Reiss, Friedhofstrasse 5, D-6050 Heusenstramm 2; Rudolf Schneider, Schnurstrasse 11, D-645 Hanau (Main), both of Fed. Rep. of Germany

[21] Appl. No.: 638,092

[22] Filed: Aug. 6, 1984

[30] Foreign Application Priority Data

Aug. 6, 1983 [DE] Fed. Rep. of Germany ..... 3328453

[51] Int. Cl.[4] ..... D06F 75/18

[52] U.S. Cl. ..... 38/77.81; 38/77.82

[58] Field of Search ..... 38/77.7, 77.8, 77.81, 38/77.82, 77.83; 219/245, 253, 254, 258

[56] References Cited

U.S. PATENT DOCUMENTS

| | | | |
|---|---|---|---|
| 2,199,911 | 5/1940 | Edwards et al. | 38/77.82 |
| 2,218,322 | 10/1940 | Eckstein | 38/77.82 |
| 2,762,143 | 9/1956 | Hoecker | 38/77.82 |
| 3,041,757 | 7/1962 | Swenson et al. | 38/77.81 |
| 3,418,736 | 12/1968 | Kueser | 38/77.81 |
| 4,196,340 | 4/1980 | Evans, Jr. et al. | 219/254 X |

*Primary Examiner*—Werner H. Schroeder
*Assistant Examiner*—Andrew M. Falik

[57] ABSTRACT

A steam iron has a water tank divided into first and second chambers and a vaporizing chamber formed in an electrically heated sole-plate of the iron. A drip valve is arranged to supply water from said first chamber to the vaporizing chamber, said first chamber being connected to atmosphere and the first and second chambers being in flow communication via at least one opening formed in a lower region of the tank. A tube connecting said vaporizing chamber to said second chamber is arranged such that its mouth opens into the second chamber above the filling level of water therein.

5 Claims, 1 Drawing Figure

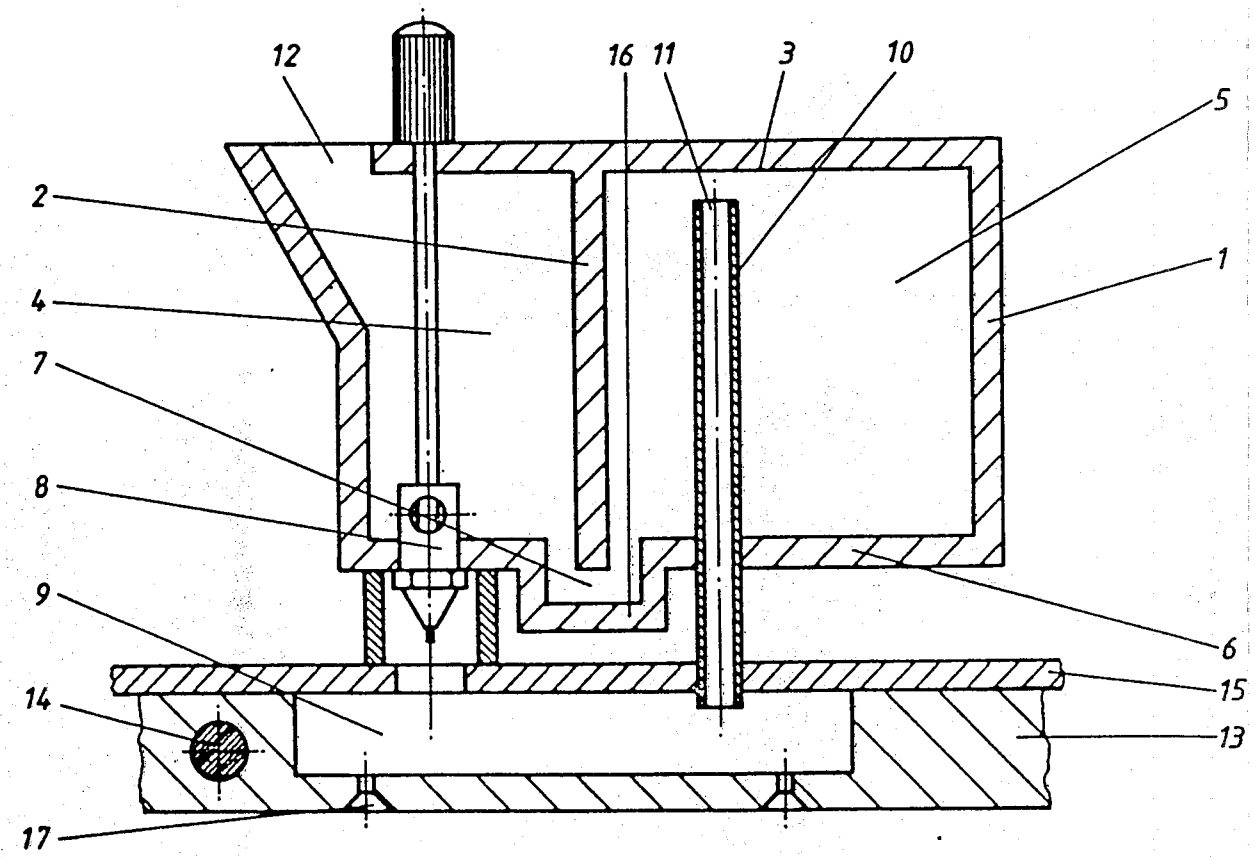
5
1
6
15
13
10
3
11
16
12
2
4
7
8
9
14
17

STEAM IRON

BACKGROUND OF THE INVENTION

The invention relates to a steam iron including a water tank and an electrically heated vaporizing chamber.

It is known to provide such an iron, which may also include a connecting tube between the vaporizing chamber and an inner chamber of the tank, and a drip valve for the supply of water from the tank into the vaporizing chamber, this being mounted in an electrically heated sole-plate of the iron. Steam irons of this type have long been known. They may be used either as dry irons or as steam irons, as desired. It is known from published patent application DE-OS No. 29 07 619 of the Federal Republic of Germany to provide a dividing wall in the tank, constructed as a baffle plate which serves to dampen any surges in the water. For steam ironing, a measured quantity of water from the tank is fed into the steam chamber provided in the sole-plate of the iron via a drip valve. As the hydrostatic pressure of the column of water acting on the valve decreases, the quantity of steam produced in the steam chamber and coming out of the sole-plate is sharply reduced. In addition, during the ironing operation, pressure builds up in the steam chamber, affecting the quantity of water flowing out of the drip valve. In order to balance out this pressure difference within the steam chamber and the interior of the tank, it has already been proposed that the tank and the vaporizing chamber be connected to each other by means of a pressure balancing tube as is known from published application DE-AS No. 1 095 779 of the Federal Republic of Germany. As a result of the balancing out of pressure between the tank and the steam chamber, the steam output measured over a certain period of time is admittedly increased compared with a steam iron without any pressure balancing, but the quantity of steam coming out of the sole-plate is continuously reduced as the contents of the tank decrease as a result of the hydrostatic pressure.

BRIEF SUMMARY OF THE INVENTION

According to the invention there is provided a steam iron including a water tank and an electrically heated vaporizing chamber, said tank having first and second chambers, a drip valve arranged to supply water from said first chamber to said vaporizing chamber, said first chamber being connected to atmosphere, the lower regions of said first and second chambers being interconnected and the region of the second chamber above the filling level of the tank being connected to the vaporizing chamber.

Preferably, the iron includes a sole-plate in which the vaporizing chamber is formed.

At least in a preferred embodiment of the invention, a steam iron is provided from whose water tank an approximately uniform quantity of water is fed into the vaporizing chamber throughout the entire steam ironing operation, so that the quantity of steam coming out of the sole-plate remains constant, irrespective of the contents of the tank. The pressure building up in the vaporizing chamber during steam ironing is conveyed into the second tank chamber, which is otherwise sealed, via the connection between these two chambers. Excess pressure is formed in the second tank chamber and the water flows into the first tank chamber which is connected to atmosphere. As a result, a higher column of water and hence a greater hydrostatic pressure is produced over the drip valve. When the valve is opened, a uniform quantity of water flows out of the tank into the vaporizing chamber. The quantity of vapor leaving the sole-plate remains constant irrespective of the quantity of liquid in the tank. Advantageously, the first tank chamber is connected to atmosphere via the tank filling opening. Preferably, the tank is divided into said first and second chambers by a dividing wall sealingly connected to an inner wall of said tank. It is also preferred that the connection between the region of the second chamber above the filling level of the tank and the vaporizing chamber is provided by a tube the mouth of which in the second chamber is disposed substantially in the region of the dividing wall.

Preferably, the first and second chambers are interconnected by an opening between the dividing wall and the base of the tank. In this case the base may have a downwardly displaced portion from which said dividing wall is spaced. Alternatively, the first and second chambers may be interconnected by a conduit mounted below the tank base, such as for example, a U-shaped tube.

Further objects and advantages will become apparent as the following description proceeds and the features of novelty which characterize the invention will be pointed out in the claims annexed to and forming a part of the specification.

BRIEF DESCRIPTION OF THE DRAWING

An embodiment of the invention will now be described by way of example and with reference to the accompanying drawing, which shows a vertical sectional view through a steam iron in accordance with the invention.

DESCRIPTION OF THE PREFERRED EMBODIMENT

The part of the steam iron shown in the drawing shows part of a sole-plate 13, a vaporizing chamber 9 and a heating element 14. The vaporizing chamber 9 is sealed off by a cover 15. A water supply container or tank 1 which can be filled up via a funnel-like filling opening 12 is mounted above the sole-plate 13. After the ironing operation has finished, any water remaining in the water tank 1 can be emptied out through the filling opening 12. During steam ironing, the water is conveyed from the tank 1 through a drip valve 8 into the vaporizing chamber 9. For dry ironing, i.e. ironing without steam, the water supply is interrupted by closing the drip valve 8. The interior of the tank is subdivided by a dividing wall 2 into a first chamber which is under atmospheric pressure and a second chamber which is not directly connected to atmosphere. In this embodiment the first chamber is a front chamber 4 and the second chamber is a back chamber 5. Between a tank base 6 and the dividing wall 2 is a throughflow opening 7 which is provided in a sump 16 formed by a bead-like convexity in the tank base 6. Between the vaporizing chamber 9 and the interior of the back chamber 5 is mounted a connecting tube 10, a mouth 11 of which ends above the water level in the back chamber 5. The water flowing into the heated vaporizing chamber 9 is converted therein from the liquid phase into the vapor phase. The excess pressure produced as a result of the increase in volume also prevails in the back chamber 5 as a result of the arrangement of the connecting tube 10. Thanks to the excess pressure prevailing here, water is conveyed from the back chamber 5 into the front chamber 4 which is only under atmospheric pressure. As a result the water level in the front chamber 4 rises and this in turn increases the static pressure acting on the drip valve 8. Independently of the water supply in the tank 1, the static pressure of the water column acting on the valve 8 is kept at the same level throughout the steam ironing process. This in turn evens out the quantity of water flowing out of the tank 1 into the vaporizing chamber 9 during steam ironing and consequently also evens out the quantity of vapor which is released into the fabric being ironed through steam exit holes 17 provided in the sole-plate 13. The quantity of steam emerging from the sole-plate 13 does not decrease sharply until the water tank 1 is completely empty. This sharp reduction in the quantity of steam shows the user that the water tank 1 needs to be refilled with water. The arrangement of the throughflow opening 7 in the sump 16 makes it possible to use virtually all the contents of the tank without any substantial decrease in the quantity of steam emerging. The same effect can also be achieved if the dividing wall 2 is fixedly connected to the base 6 of the water tank 1 and the two chambers 4 and 5 are connected to each other via a U-shaped tube fixed underneath the tank base 6.

What is claimed as new and desired to be secured by Letters Patent of the United States is:

1. A steam iron comprising: a water tank; said tank having a dividing wall dividing said tank into first and second chambers; an electrically heated sole-plate; a vaporizing chamber formed in said sole-plate; a drip valve mounted in said first chamber to supply water from said first chamber to said vaporizing chamber; means connecting said first chamber to atmosphere; said dividing wall of said tank being connected in sealed manner to an inner wall of said tank; means defining at least one opening in a lower region of said tank to put said first and second chambers in flow communication; and a tube connecting said vaporizing chamber to said second chamber, the mouth of the tube opening into said second chamber above the filling level of water therein.

2. A steam iron as claimed in claim 1, wherein said means connecting said first chamber to atmosphere comprises a water filling opening of the iron.

3. A steam iron as claimed in claim 1, wherein said tank includes a base having a downwardly displaced portion and said opening defining means comprises said dividing wall being spaced from said downwardly displaced portion of the base.

4. A steam iron as claimed in claim 1, wherein said mouth of the tube opens into said second chamber in the region of said dividing wall.

5. A steam iron including a water tank and an electrically heated vaporizing chamber, said tank having first and second chambers, a drip valve arranged to supply water from said first chamber to said vaporizing chamber, said first chamber being connected to atmosphere, the lower regions of said first and second chambers being interconnected and the region of the second chamber above the filling level of the tank being connected to the vaporizing chamber.

* * * * *